US011697901B2

(12) United States Patent
Masters

(10) Patent No.: US 11,697,901 B2
(45) Date of Patent: Jul. 11, 2023

(54) DOOR ASSEMBLY FOR A LAUNDRY TREATING APPLIANCE

(71) Applicant: WHIRLPOOL CORPORATION, Benton Harbor, MI (US)

(72) Inventor: Roy E. Masters, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 61 days.

(21) Appl. No.: 17/106,649

(22) Filed: Nov. 30, 2020

(65) Prior Publication Data

US 2021/0214880 A1 Jul. 15, 2021

Related U.S. Application Data

(60) Provisional application No. 62/958,811, filed on Jan. 9, 2020.

(51) Int. Cl.
*D06F 39/14* (2006.01)

(52) U.S. Cl.
CPC ..... *D06F 39/14* (2013.01)

(58) Field of Classification Search
CPC ..... D06F 39/14
USPC ..... 68/196
See application file for complete search history.

(56) References Cited

U.S. PATENT DOCUMENTS

| | | | | |
|---|---|---|---|---|
| 5,279,047 | A | 1/1994 | Jenecke | |
| 2008/0087307 | A1 | 4/2008 | Han et al. | |
| 2009/0249837 | A1 | 10/2009 | Uhara et al. | |
| 2011/0126864 | A1* | 6/2011 | Kim | A47L 15/483 134/115 R |
| 2019/0177905 | A1 | 6/2019 | Ayers et al. | |

FOREIGN PATENT DOCUMENTS

| | | | | |
|---|---|---|---|---|
| DE | 4109441 | A1 | 9/1992 | |
| EP | 0481178 | A1 | 4/1992 | |
| EP | 0789105 | | 8/1997 | |
| EP | 0755466 | B1 | 12/1999 | |
| EP | 1837434 | A1 | 9/2007 | |
| EP | 2522771 | A2 | 11/2012 | |
| EP | 2449164 | B1 | 3/2013 | |
| GN | 105177914 | B | 12/2017 | |
| WO | WO-2011000705 | A1 * | 1/2011 | D06F 58/206 |

* cited by examiner

*Primary Examiner* — Tinase B Ayalew
(74) *Attorney, Agent, or Firm* — Price Heneveld LLP

(57) ABSTRACT

A door assembly for selectively opening and closing an access opening to a treating chamber of a laundry treating appliance includes an inner door wall and an outer door wall adjacent to the inner door wall, wherein the outer door wall and the inner door wall at least partially define an internal volume. The inner door wall includes a portion that is configured to extend at least partially into the treating chamber when the door is closed, and includes an air inlet and an air outlet. The door assembly is configured such that the internal volume is in fluid communication with an airflow inside the treating chamber when the door assembly is closed.

17 Claims, 6 Drawing Sheets

DOOR ASSEMBLY FOR A LAUNDRY TREATING APPLIANCE

CROSS-REFERENCE TO RELATED APPLICATIONS

This application claims priority to U.S. Provisional Patent Application No. 62/958,811, filed on Jan. 9, 2020, entitled "DOOR ASSEMBLY FOR A LAUNDRY TREATING APPLIANCE," the disclosure to which is hereby incorporated herein by reference in its entirety.

BACKGROUND OF THE DISCLOSURE

The present disclosure generally relates to a door for a laundry treating appliance, and more specifically, to a door for a laundry treating appliance configured to dry laundry items using an airflow.

Laundry treating appliances such as clothes dryers, condensing dryers, and combination washer/dryer appliances, typically provide an airflow, often a heated airflow, to a treating chamber for drying laundry items contained therein during a drying cycle of operation. During a conventional drying cycle of operation, an airflow is circulated through the treating chamber and moisture carried by the laundry items is evaporated and carried out of the treating chamber by the airflow. In some appliances, the moisture carrying airflow is vented from the appliance and ambient air from exterior to the appliance is circulated into the treating chamber. In other types of appliances, the moisture carrying airflow is moved through a condensing or heat exchanging system to condense moisture from the airflow and the airflow is then recirculated back into the treating chamber.

SUMMARY OF THE DISCLOSURE

According to one aspect of the present disclosure, a laundry treating appliance includes a cabinet defining an interior, a drum disposed within the cabinet and at least partially defining a treating chamber for treating laundry according to a cycle of operation, a blower configured to supply an airflow into the treating chamber to evaporate moisture from the laundry during a cycle of operation, and a door assembly coupled to the cabinet and configured to selectively open and close an access opening to the treating chamber.

According to another aspect of the present disclosure, a door assembly for selectively opening and closing an access opening to a treating chamber of a laundry treating appliance is provided. The door assembly includes an inner door wall having a portion that is configured to extend at least partially into the treating chamber when the door is closed, wherein the inner door wall includes an air inlet and an air outlet and an intermediate wall adjacent to the inner door wall, wherein the intermediate wall and the inner door wall at least partially define an internal volume. The door assembly also includes a baffle projecting from the inner door wall into the internal volume, wherein the baffle is disposed between the air inlet and the air outlet. An exterior door wall is disposed adjacent to the intermediate door wall, opposite the inner door wall, wherein the exterior door wall and the intermediate door wall at least partially define an external volume in fluid communication with ambient air. The internal volume is in fluid communication with an airflow inside the treating chamber when the door assembly is closed.

According to yet another aspect of the present disclosure, a door assembly for selectively opening and closing an access opening to a treating chamber of a laundry treating appliance is provided. The door assembly includes an inner door wall including a portion that is configured to extend at least partially into the treating chamber when the door is closed, wherein the inner door wall includes an air inlet and an air outlet, and an outer door wall adjacent to the inner door wall, wherein the outer door wall and the inner door wall at least partially define an internal volume. The door assembly also includes a baffle projecting from the inner door wall into the internal volume, wherein the baffle is disposed between the air inlet and the air outlet, and at least one blower is disposed adjacent one of the air inlet, the air outlet, or both and configured to move an airflow through the internal volume.

These and other features, advantages, and objects of the present disclosure will be further understood and appreciated by those skilled in the art by reference to the following specification, claims, and appended drawings.

Figure 1A:
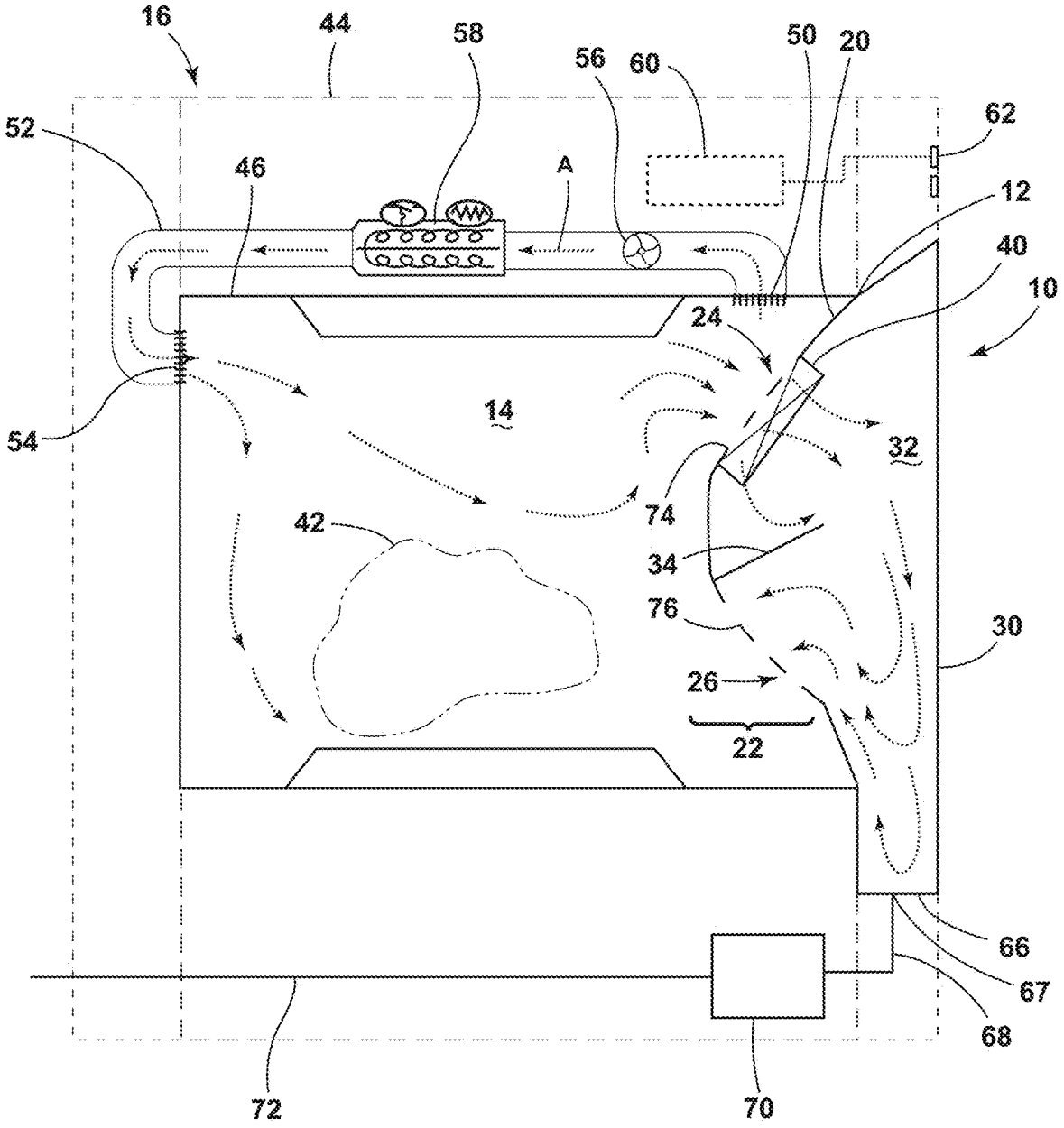
FIG. 1A is a cross-sectional view of a schematic of a laundry treating appliance having a closed loop airflow system and a door assembly, according to an aspect of the present disclosure.

The components in the figures are not necessarily to scale, emphasis instead being placed upon illustrating the principles described herein.

DETAILED DESCRIPTION

The present illustrated embodiments reside primarily in combinations of apparatus components relating to a door assembly for a laundry treating appliance that is configured to dry laundry items by circulating an airflow through the laundry items during a cycle of operation. The door assembly can be configured to condense moisture carried by the airflow to facilitate drying the laundry items during the cycle of operation. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended user during use, and the term "rear" shall refer to the surface of the element further from the intended user. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 1B:
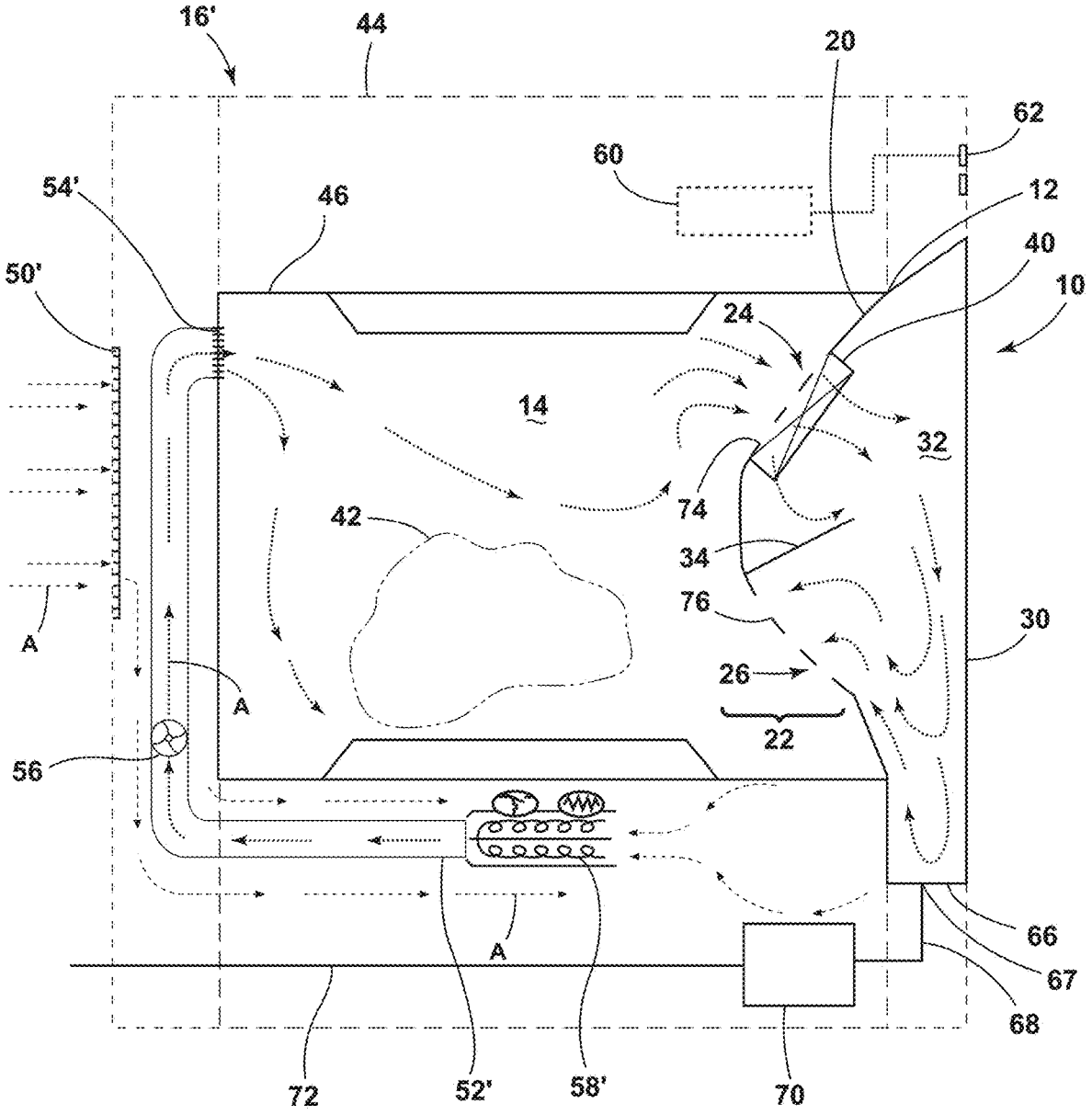
FIG. 1B is a cross-sectional view of a schematic of a laundry treating appliance having an open loop airflow system and a door assembly, according to an aspect of the present disclosure

Referring to FIGS. 1A-B, reference numeral 10 generally designates a door assembly for selectively opening and closing an access opening 12 to a treating chamber 14 of a laundry treating appliance 16. The door assembly 10 can include an inner door wall 20 having a portion 22 that is configured to extend at least partially into the treating chamber 14 when the door assembly 10 is in the closed position. The inner door wall 20 can include an air inlet 24 and an air outlet 26. The door assembly 10 can also include an outer door wall 30 that is adjacent to the inner door wall 20. The inner door wall 20 and the outer door wall 30 can at least partially define an internal volume 32 of the door assembly 10. A baffle 34 can project from the inner door wall 20 into the internal volume 32 and can be disposed between the air inlet 24 and the air outlet 26. At least one blower 40 can be disposed adjacent to the air inlet 24, the air outlet 26, or both the air inlet and the air outlet 24, 26. The at least one blower 40 can be configured to move an airflow through the internal volume 32.

Figure 2:
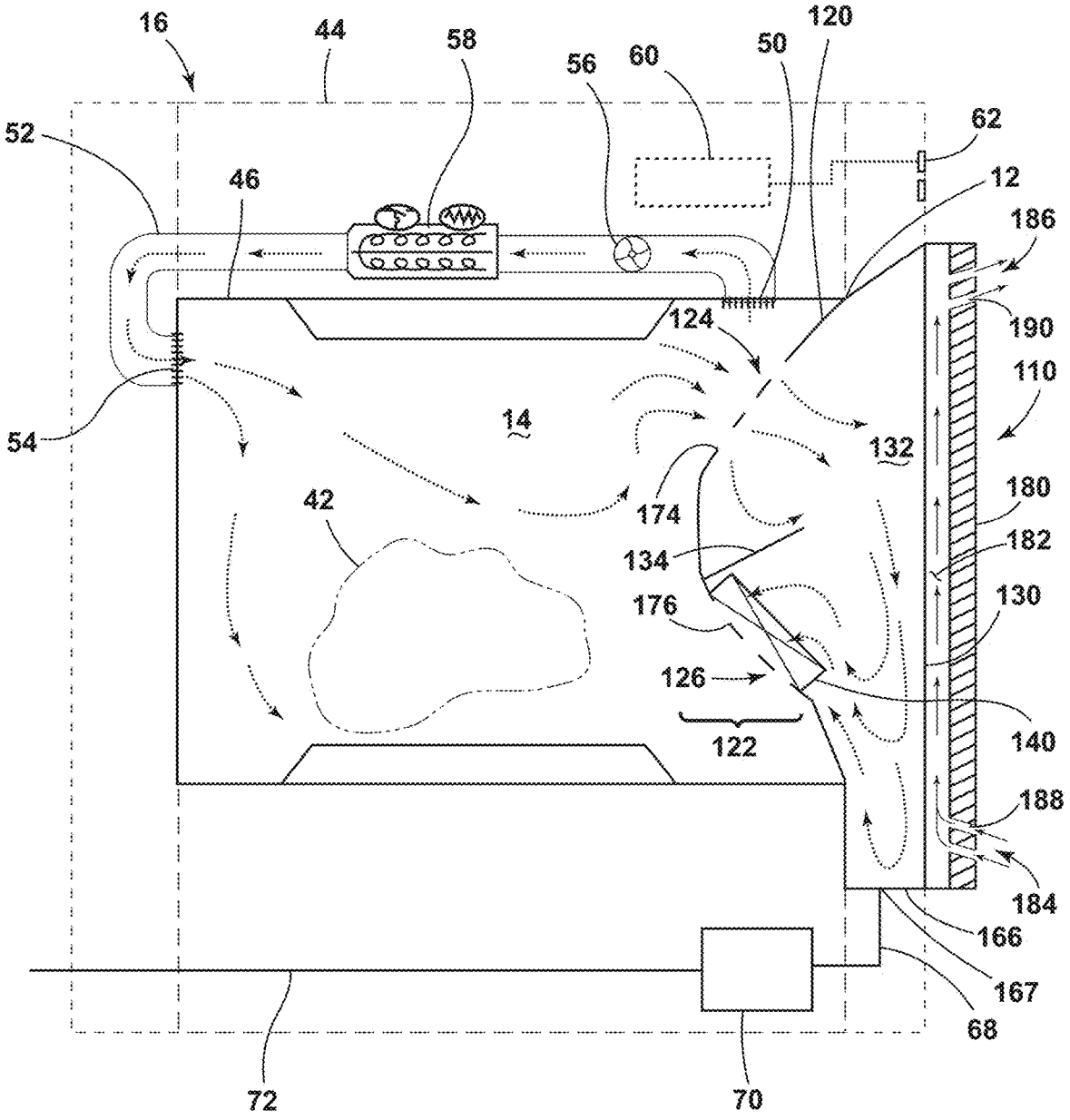
FIG. 2 is a cross-sectional view of a schematic of a laundry treating appliance having a closed loop airflow system and a door assembly, according to an aspect of the present disclosure.

The laundry treating appliance 16 can be any laundry treating appliance that is configured to supply an airflow to the treating chamber 14 to at least partially dry laundry items 42 contained therein during a cycle of operation. Examples of suitable laundry treating appliances include a condensing clothes dryer and a combination washer and dryer. In the embodiments of FIGS. 1A and 2, the laundry treating appliance 16 is configured as a condensing clothes dryer having a closed loop airflow system, although it is understood that aspects of the present disclosure can be used in a similar manner with a combination washer/dryer or any type of laundry treating appliance capable of treating laundry items with an airflow during a cycle of operation.

The laundry treating appliance 16 can include an appliance cabinet 44 housing a rotatable drum 46 which at least partially defines the treating chamber 14. The drum 46 can include an open end that generally aligns with the access opening 12, through which items can be loaded and unloaded into the treating chamber 14. The laundry treating appliance 16 can also include an airflow system that is configured to supply an airflow through the treating chamber 14 during a cycle of operation. The airflow system can include an air supply portion that is formed, at least in part, by a treating chamber outlet 50, an air supply conduit 52, a treating chamber inlet 54, and an appliance blower 56. The airflow system may optionally include a heating component 58 for heating air supplied to the treating chamber 14 through the air supply conduit 52. The heating component 58 can be any suitable type of heating system, examples of which include an open-coil heating system, an induction heating system, and a radiant heating system. The laundry treating appliance 16 can also include a controller 60 that is communicably coupled with components of the laundry treating appliance 16 for controlling the components during a cycle of operation and/or receiving output signals from the components. For example, the controller 60 can be communicably coupled with the appliance blower 56 and/or the heating component 58 to control the operation of these components during a cycle of operation. The laundry treating appliance 16 can also include a user interface 62 that is communicably coupled with the controller 60. The user interface 62 can be any suitable type of user interface through which the user can control the appliance to select a cycle of operation and the appliance can communicate with the user. The user interface 62 may include one or more knobs, switches, buttons, displays, touchscreens, etc. The laundry treating appliance 16 can include additional components that may be found in a clothes dryer or a combination washer/dryer, which are not described in more detail for the sake of brevity.

While aspects of the present disclosure are discussed in the context of a closed airflow system, such as illustrated in FIGS. 1A and 2, it is also within the scope of the present disclosure for any of the aspects described herein to be used in a laundry treating appliance having a partially closed loop airflow system or open loop airflow system, an example of which is illustrated in FIG. 1B. FIG. 1B illustrates a laundry treating appliance 16' that has some similarities to the laundry treating appliance 16 of FIG. 1A, but differs in the configuration of the airflow system. In the open loop airflow system of FIG. 1B, the airflow system can include an air supply portion that is formed, at least in part, by an ambient air vent 50', an air supply conduit 52', a treating chamber inlet 54', and an appliance blower 56'.

Referring again to FIG. 1A, the door assembly 10 can have a shape and dimensions configured to form a seal with the access opening 12 when the door assembly 10 is in the closed position. In one example, the appliance cabinet 44 can include a gasket extending around a periphery of the access opening 12 which is configured to form a seal with the inner door wall 20 when the door assembly 10 is in the closed position. In another example, the inner door wall 20 can include a gasket that is configured to form a seal with the appliance cabinet 44 around a periphery of the access opening 12. When the laundry treating appliance 16 is a combination washer/dryer, the rotatable drum 46 can be housed within a tub that can be sealed with the access opening 12 by a bellows in a manner similar to a conventional washing machine or combination washer/dryer. In one aspect, the bellows can be configured to form a seal with the inner door wall 20 when the door assembly 10 is in the closed position.

The door assembly 10 can include a bottom wall 66 extending between the inner door wall 20 and the outer door wall 30. A liquid outlet 67 can be provided in a bottom portion of the door assembly 10, such as the bottom wall 66, for draining liquid that may have collected along the bottom wall 66 within the internal volume 32. The bottom wall 66 may define the bottom wall 66 of the internal volume 32, as well as the bottom wall of the door assembly 10, as illustrated. Optionally, the bottom wall 66 may define a portion of the internal volume 32 and a secondary exterior wall may form a bottom wall of the door assembly 10. A drain conduit 68 can connect the liquid outlet 67 with a storage container 70 that is configured to receive liquid drained from the internal volume 32. The storage container 70 can be coupled with an external drain line 72 for draining the collected condensate to an exterior of the laundry treating appliance 16. Optionally, the storage container 70 may be configured to be selectively removed and emptied by a user of the laundry treating appliance 16. In one aspect, the drain conduit 68 may be coupled with a pump that is communicably coupled with the controller 60 for actively draining condensate from the internal volume 32. The pump may be coupled with the storage container 70 for pumping liquid into the storage container 70 and/or coupled with the external drain line 72 for pumping liquid directly to the external drain line 72. When the laundry treating appliance 16 is a combination washer/dryer, the drain conduit 68 can be coupled with the appliance drain system, such as a sump or external drain line 72.

The inner door wall 20 can be configured such that at least a portion of the airflow supplied to the treating chamber 14 during a cycle of operation can enter into the internal volume 32 through the air inlet 24 and exit the internal volume 32 and flow back into the treating chamber 14 through the air outlet 26. The air inlet 24 and the air outlet 26 can have any suitable shape and dimensions to facilitate the desired movement of the airflow between the treating chamber 14 and the internal volume 32. In one aspect, the air inlet 24 and the air outlet 26 can be in the form of one or more apertures 74 and 76, respectively. The one or more apertures 74, 76 can have any suitable cross-sectional shape, examples of which include circular, oval, square, rectangular, diamond, etc. The number, dimensions, and/or shape of the one or more apertures 74 forming the air inlet 24 and the one or more apertures 76 forming the air outlet 26 can be the same or different.

The portion 22 of the inner door wall 20 can have a cross-sectional shape that is convex, concave, flat, or any other suitable geometric cross-sectional shape and may be symmetrical or asymmetrical along one or more axes. The portion 22 may include curved, straight, and/or angled sub-portions. In one example, the inner door wall 20 can have a convex cross-sectional shape similar to a conventional fishbowl or bubble-style door. The air inlet 24 and the air outlet 26 may be individually formed in a curved, straight, and/or angled portion of the inner door wall 20.

The inner door wall 20 can be made from any suitable type of material, examples of which include glass, metal, metal alloys, aluminum, steel, stainless steel, and polymeric materials. In one aspect, the baffle 34 can be coupled with the inner door wall 20 using any suitable mechanical and/or non-mechanical fastener, examples of which include screws, clamps, clips, adhesives, and welds. In another aspect, the baffle 34 can be integrally formed with the inner door wall 20 (e.g., by molding). The baffle 34 can be made from the same or different material than the inner door wall 20.

The baffle 34 can project from the inner door wall 20 into the internal volume 32 at any location along the inner door wall 20 between the air inlet 24 and the air outlet 26. The dimensions of the baffle 34 and an angle at which the baffle 34 extends into the internal volume 32 can be selected based on the dimensions and shape of the internal volume 32 and/or desired airflow characteristics of the airflow moving through the internal volume 32.

The blower 40 can be located adjacent to the air inlet 24, as illustrated in FIG. 1A, to facilitate drawing at least a portion of the airflow in the treating chamber 14 into the internal volume 32 of the door assembly 10. In one aspect, the blower 40 can be located within the internal volume 32, as such a location may minimize the likelihood that laundry items will snag on components of the blower 40. Optionally, a filter screen may be disposed at the air inlet 24 and/or at the blower 40 to filter out particulate matter that may be carried by the airflow, and which could clog and/or damage the blower 40. In another aspect, the blower 40 can be disposed adjacent to the air outlet 26 in combination with or as an alternative to placing the blower 40 at the air inlet 24. When the blower 40 is disposed at the air outlet 26, the blower 40 can be configured to draw air from the internal volume 32 and exhaust the air into the treating chamber 14. In some aspects, the door assembly 10 may not include a blower 40. For example, in some aspects, the airflow provided by the appliance blower 56 and/or movement of the laundry items in the treating chamber 14 during a cycle of operation may provide sufficient airflow through the internal volume 32 without the assistance of a blower.

The outer door wall 30 can be configured to be generally flush with a front face of the appliance cabinet 44 (as illustrated) or may be configured to extend beyond the appliance cabinet 44 or be recessed with respect to the appliance cabinet 44. The outer door wall 30 can be made from the same or different material as the inner door wall 20. The outer door wall 30 can be sealed with the inner door wall 20 to isolate the internal volume 32 from the exterior environment. The outer door wall 30 can be sealed with the inner door wall 20 using any suitable mechanical and/or non-mechanical fasteners, examples of which include screws, clamps, clips, adhesives, and welds. One or more sealants and/or gaskets may optionally be used to provide an air-tight and liquid-tight seal between at least portions of the outer door wall 30 and the inner door wall 20.

According to one aspect of the present disclosure, the outer door wall 30 includes a material that has a higher thermal conductivity than the material forming the inner door wall 20. For example, the outer door wall 30 may include a material such as aluminum, which has a higher thermal conductivity compared to most glasses which would be considered for use in forming the inner door wall 20. In another example, the outer door wall 30 can include a conductive coating or film that increases a thermal conductivity of the outer door wall 30. In yet another example, the outer door wall 30 may include structural features to help increase the thermal conductivity of the outer door wall 30, such as a wavy, bumpy, or otherwise textured surface.

During a drying cycle of operation, the appliance blower 56 can be controlled by the controller 60 to supply an airflow through the treating chamber 14 through the air supply system, as indicated by arrows A. Aspects of the present disclosure may be used with any conventional treating cycle of operation, such as a drying cycle, of a combination washer/dryer, condensing dryer, or any other type of laundry treating appliance that involves supplying an airflow to a treating chamber of the appliance. The airflow supplied to the treating chamber 14 can interact with the laundry items in the treating chamber 14 and cause at least a portion of the moisture carried by the laundry items to evaporate and be carried by the airflow. In some cycles, the heating component 58 can be operated by the controller 60 to heat the airflow supplied to the treating chamber 14 to facilitate evaporating moisture carried by the laundry.

During at least a portion of a treating cycle of operation intended to dry laundry items, the controller 60 can control the blower 40 to move at least a portion of the airflow from the treating chamber 14 through the internal volume 32 of the door assembly 10. The airflow can enter the internal volume 32 through the air inlet 24, move through the internal volume 32, and then re-enter the treating chamber 14 through the air outlet 26. As the airflow moves through the internal volume 32, at least a portion of the moisture carried by the airflow is condensed from the airflow and collected along the bottom wall 66 of the door assembly 10. The environment exterior to the laundry treating appliance 16 will typically be cooler than the environment within the treating chamber 14, which can result in the outer door wall 30 having a sufficiently lower temperature than the incoming airflow to induce condensation of at least a portion of the moisture carried by the airflow. Generally speaking, the greater the temperature difference between the temperature of the outer door wall 30 and a temperature of the airflow in the treating chamber 14, the more efficiently liquid will be condensed from the airflow as the airflow moves through the internal volume 32 of the door assembly 10. Condensing moisture carried by the airflow results in the airflow that is re-entering the treating chamber 14 through the air outlet 26 having a lower moisture content than the airflow that entered the internal volume 32. The lower moisture content airflow that re-enters the treating chamber 14 can more efficiently evaporate moisture carried by the laundry items.

The blower 40 can be communicably coupled with the controller 60 and can be operated continuously or according to a blower profile during all or a portion of the cycle of operation. The blower profile may be a profile stored by the controller 60 and/or may be based on one or more measured or determined conditions of the laundry items and/or the laundry treating appliance 16, non-limiting examples of which include the selected cycle of operation, an airflow through the treating chamber 14, a moisture content of the laundry items, a moisture content of the airflow, a temperature of laundry items, an amount of condensate collected within the internal volume 32, etc. In some aspects, the blower 40 may not be operated during an entirety or a portion of the cycle of operation. For example, in some aspects, the airflow provided by the appliance blower 56 and/or movement of the laundry items in the treating chamber 14 during a cycle of operation may provide sufficient airflow through the internal volume 32 without the assistance of the blower 40. Optionally, in some aspects the door assembly 10 may not include a blower 40.

This process of evaporating moisture from the laundry items in the treating chamber 14, moving the moisture-laden airflow through the internal volume 32, condensing at least some of the moisture within the internal volume 32 to reduce the moisture content of the airflow, and supplying the lower moisture content airflow back into the treating chamber 14 can be repeated until the cycle of operation is complete. The cycle of operation can be determined to be complete according to any conventional end of cycle indicator. For example, the cycle of operation can be determined to be complete when the laundry items are determined to have reached a predetermined moisture content and/or when a predetermined time period has elapsed.

The blower 40 facilitates movement of the airflow between the treating chamber 14 and the internal volume 32. The number, power, and location of the blower 40 (e.g., located at the air inlet 24, the air outlet 26, or both) can be selected to move the airflow between the treating chamber 14 and the internal volume 32 based at least in part on factors such as a drying speed of the cycle of operation, a length of the cycle of operation, and a condensing efficiency within the internal volume 32. For example, if the airflow moves too quickly through the internal volume 32, the condensing efficiency within the internal volume may be too low and amount of moisture condensed from the airflow may not be sufficient for the drying cycle of operation to proceed in an acceptable manner. The baffle 34 can also be configured to facilitate movement of the airflow through the internal volume 32 by increasing a length of time that the airflow remains within the internal volume 32 before re-entering the treating chamber 14 through the air outlet 26. Increasing the length of time the airflow remains within the internal volume 32 may allow for more interaction between the airflow and the cooler temperatures of the outer door wall 30, which can facilitate condensation of moisture from the airflow.

In a conventional combination washer/dryer or condensing dryer, the airflow in the treating chamber 14 is supplied to a condensing or heat exchanging unit that is housed within the appliance cabinet. The environment within the appliance cabinet will typically be warmer than the environment exterior of the appliance cabinet, which can impact a condensing efficiency of the condensing or heat exchanging unit. Aspects of the present disclosure utilize the environment exterior of the appliance cabinet 44 to facilitate condensing moisture from the airflow during a cycle of operation. In one aspect, access to the cooler exterior environment may facilitate shortening drying times by improving the ability to condense moisture from the airflow during the cycle of operation. The aspects of the door assembly 10 described herein can be used in place of a conventional condensing or heat exchanging unit that is housed within the appliance cabinet or in combination with a conventional condensing or heat exchanging unit to facilitate drying laundry items during a cycle of operation.

Moisture condensed from the airflow as the airflow moves through the internal volume 32 will generally collect along the bottom wall 66 of the door assembly 10 or another designated collection area within the internal volume 32. Condensed liquid collected along the bottom wall 66 can be drained through the liquid outlet 67 before, during, and/or after a cycle operation. In one example, the liquid outlet 67 can be coupled with a valve or pump that is controlled by the controller 60 to drain liquid from the internal volume 32 following a predetermined event and/or after a predetermined period of time. Examples of a predetermined event that could trigger the controller 60 to actuate the valve or pump include: an end of a cycle of operation, a start of a cycle of operation, or a closing of the door assembly 10 after a cycle of operation has ended or prior to the start of a cycle of operation. In another example, the valve or pump may be manually activated by a user providing a corresponding input to the controller 60 through the user interface 62. In another example, the door assembly 10 may include a liquid level sensor that is communicably coupled with the controller 60 or coupled directly with the valve or pump to actuate the valve or pump when the liquid collected along the bottom wall 66 reaches a predetermined level. In yet another aspect, the liquid outlet 67 can be coupled with a valve that is configured to automatically open when the door assembly 10 is closed to thereby drain any liquid that may have collected along the bottom wall 66.

FIG. 2 illustrates a door assembly 110 that includes some components that are similar to the door assembly 10 of FIG. 1A and some components that are different. Therefore, elements of the door assembly 110 that are similar to the door assembly 10 are labeled with the prefix 100.

As illustrated in FIG. 2, the door assembly 110 includes an exterior door wall 180 disposed adjacent to an exterior side of the outer door wall 130. The exterior door wall 180 and the outer door wall 130 at least partially define an external volume 182. In the embodiment of FIG. 2, the outer door wall 130 is disposed between the inner door wall 120 and the exterior door wall 180, and thus may be referred to as intermediate wall 130. The door assembly 110 of FIG. 2 can include a blower 140 that is disposed adjacent the air outlet 126. However, it is within the scope of the present disclosure for the blower 140 to be disposed adjacent the air inlet 124, as illustrated with respect to the blower 40 of FIG. 1A, or at both the air inlet 124 and the air outlet 126.

Still referring to FIG. 2, the external volume 182 is configured to be in fluid communication with the environment exterior to the door assembly 110 such that ambient air can flow through the external volume 182. The exterior door wall 180 can include an ambient air inlet 184 through which ambient air may enter the external volume 182 and an ambient air outlet 186 through which the ambient air may exit the external volume 182. According to one aspect of the present disclosure, ambient airflow may move through the external volume 182 by natural convection. In another aspect, an optional blower (not shown) may be provided adjacent the ambient air inlet 184 and/or the ambient air outlet 186 to facilitate movement of the ambient airflow through the external volume 182.

The ambient air inlet 184 and the ambient air outlet 186 can have any suitable shape and dimensions to facilitate the desired movement of the ambient airflow through the external volume 182. In one aspect, the ambient air inlet 184 and the ambient air outlet 186 can be in the form of one or more apertures 188 and 190, respectively. The apertures 188, 190 can have any suitable cross-sectional shape, examples of which include circular, oval, square, rectangular, diamond, etc. The number, dimensions, and/or shape of the apertures 188 forming the ambient air inlet 184 and the apertures 190 forming the ambient air outlet 186 can be the same or different. As illustrated in the embodiment of FIG. 2, the ambient air inlet 184 and the ambient air outlet 186 can be provided in a front face of the exterior door wall 180. In another aspect, the ambient air inlet 184 and the ambient air outlet 186 may be disposed within a lower wall and an upper wall, respectively, that extends between the intermediate wall 130 and the exterior door wall 180.

The exterior door wall 180 can be made from any suitable type of material, examples of which include glass, metal, metal alloys, aluminum, steel, stainless steel, and polymeric materials. The exterior door wall 180 can be made from the same or different material than the inner door wall 120 and/or the intermediate wall 130. According to one aspect, the exterior door wall 180 is configured to provide the door assembly 110 with a desired aesthetic appearance. The door assembly 110 can be configured such that the exterior door wall 180 is generally flush with a front face of the appliance cabinet 44, extends beyond a front face of the appliance cabinet 44 (as illustrated), or is recessed with respect to the front face of the appliance cabinet 44.

During a drying cycle of operation, the appliance blower 56 can be controlled by the controller 60 to supply an airflow through the treating chamber 14 through the air supply system, as indicted by arrows A, in a manner similar to that as described above with respect to FIG. 1A. During at least a portion of the drying cycle of operation, the controller 60 can control the blower 140 to move at least a portion of the airflow from the treating chamber 14 through the internal volume 132 of the door assembly 110 of the embodiment of FIG. 2 in a manner similar to that described above with respect to the door assembly 10 of FIG. 1A. As the airflow moves through the internal volume 132, at least a portion of the moisture carried by the airflow is condensed from the airflow and collected within the internal volume 132.

As discussed above, the environment exterior to the laundry treating appliance 16 will typically be cooler than the environment within the treating chamber 14. The cooler ambient environment can result in the intermediate wall 130 having a sufficiently lower temperature than the airflow coming from the treating chamber 14 to induce condensation of at least a portion of the moisture carried by the airflow. The external volume 182 can be configured to allow air from exterior to the laundry treating appliance 16 to flow through the external volume 182 such that the intermediate wall 130 can be exposed to the ambient air. Generally speaking, the exterior air will be cooler than the airflow within the treating chamber 14. The external volume 182 allows the intermediate wall 130 to be exposed to this cooler, ambient air, which can facilitate condensing moisture from the airflow as the airflow passes through the internal volume 132 during a cycle of operation. The ambient air moving through the external volume 182 can help to cool the intermediate wall 130. By cooling the intermediate wall 130, this intermediate wall 130 can continually operate to facilitate condensing moisture from the airflow in the internal volume 132.

According to an aspect of the present disclosure, the intermediate wall 130 includes a material that has a higher thermal conductivity than the material forming the inner door wall 120. For example, the intermediate wall 130 may include a material such as aluminum, which has a higher thermal conductivity compared to most glasses which would be considered for use in forming the inner door wall 120. In another example, the intermediate wall 130 can include a conductive coating or film that increases a thermal conductivity of the intermediate wall 130. In yet another example, the intermediate wall 130 may include structural features to help increase the thermal conductivity of the intermediate wall 130, such as a wavy, bumpy, or otherwise textured surface. In some aspects, the exterior door wall 180 can be any suitable material, for example a material selected to provide a desired aesthetic or other functional feature to the door assembly 110.

Figure 3:
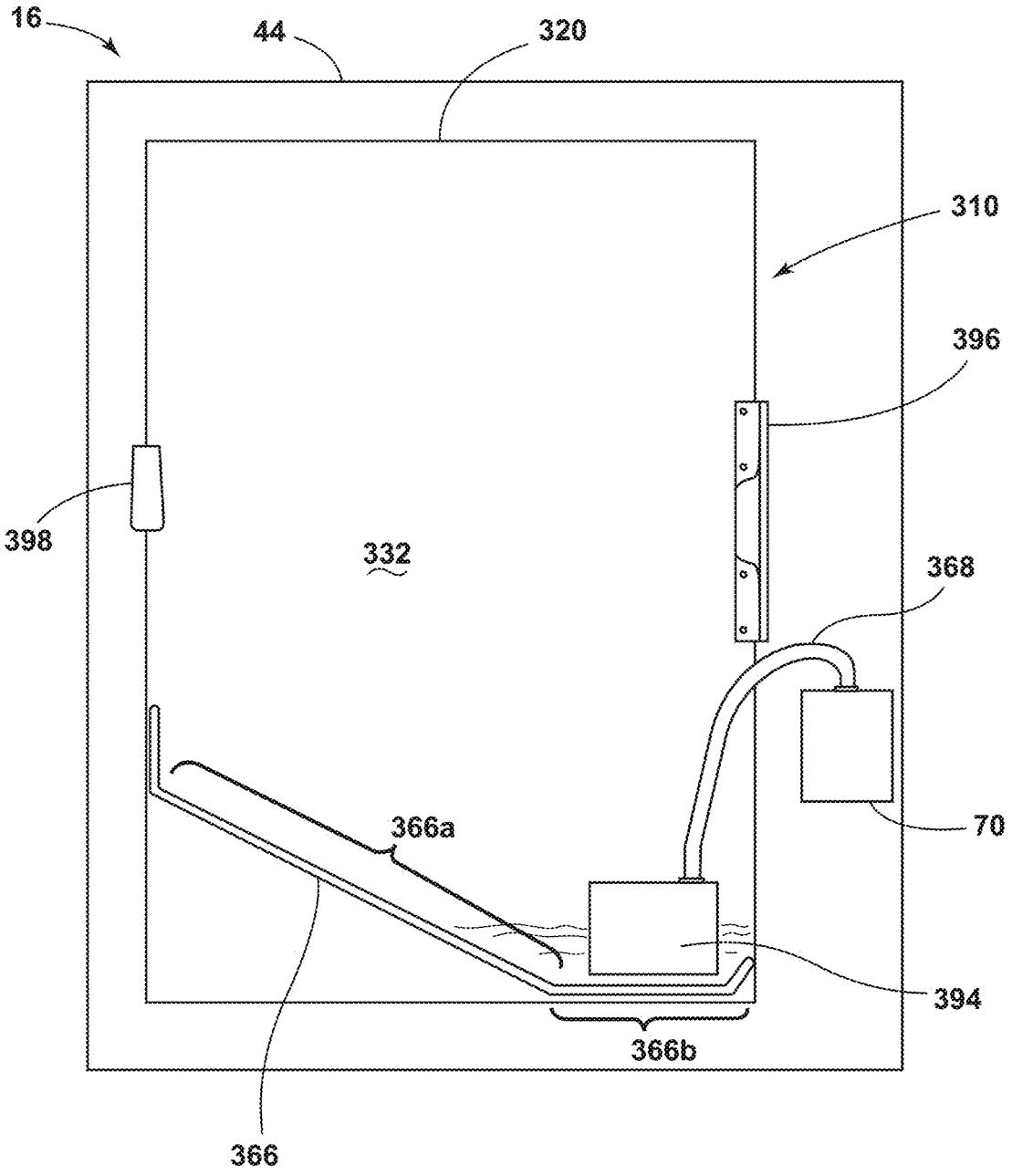
FIG. 3 is a front view of a schematic of a laundry treating appliance and a door assembly, according to an aspect of the present disclosure.
Figure 4:
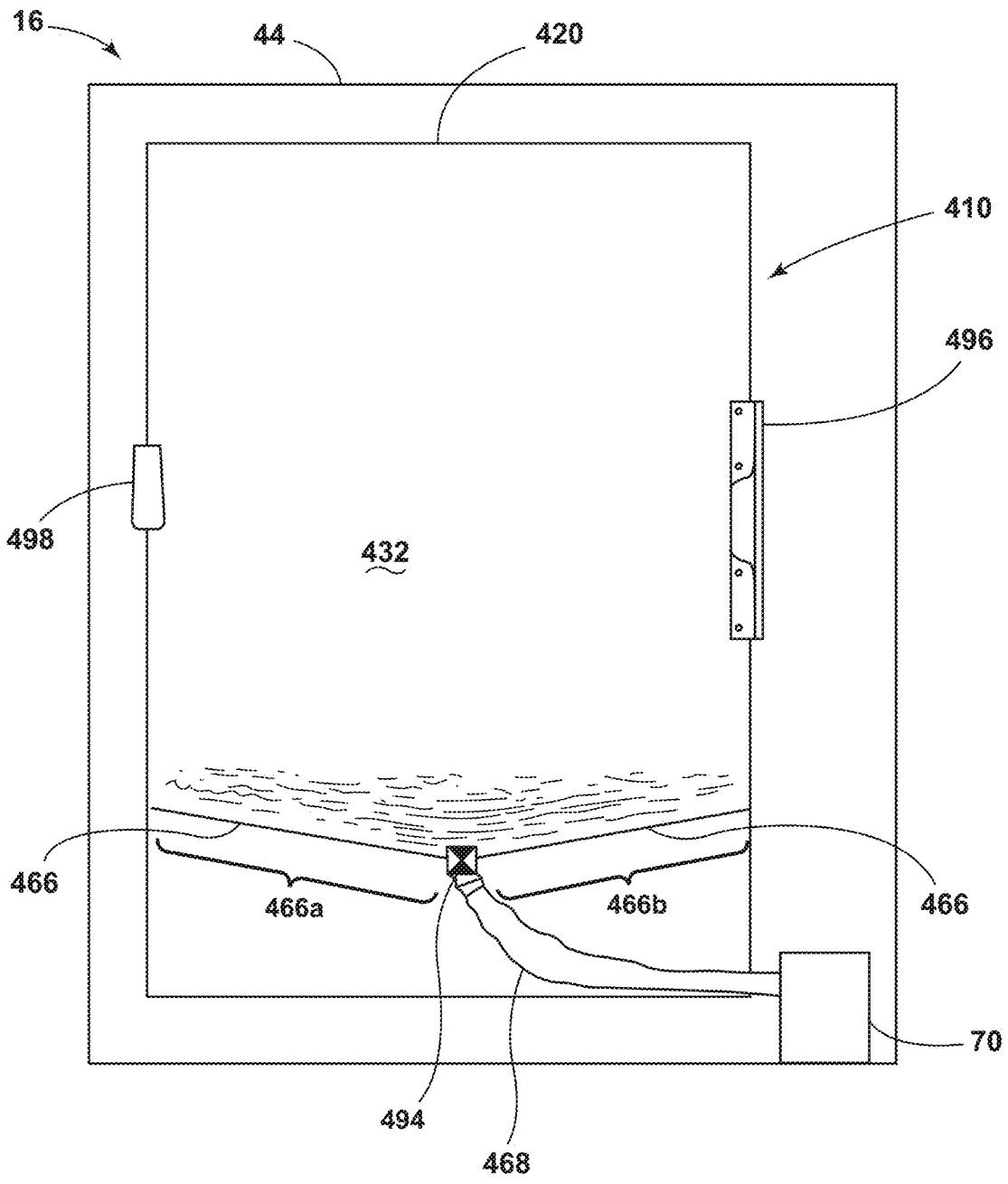
FIG. 4 is a front view of a schematic of a laundry treating appliance and a door assembly, according to an aspect of the present disclosure.
Figure 5:
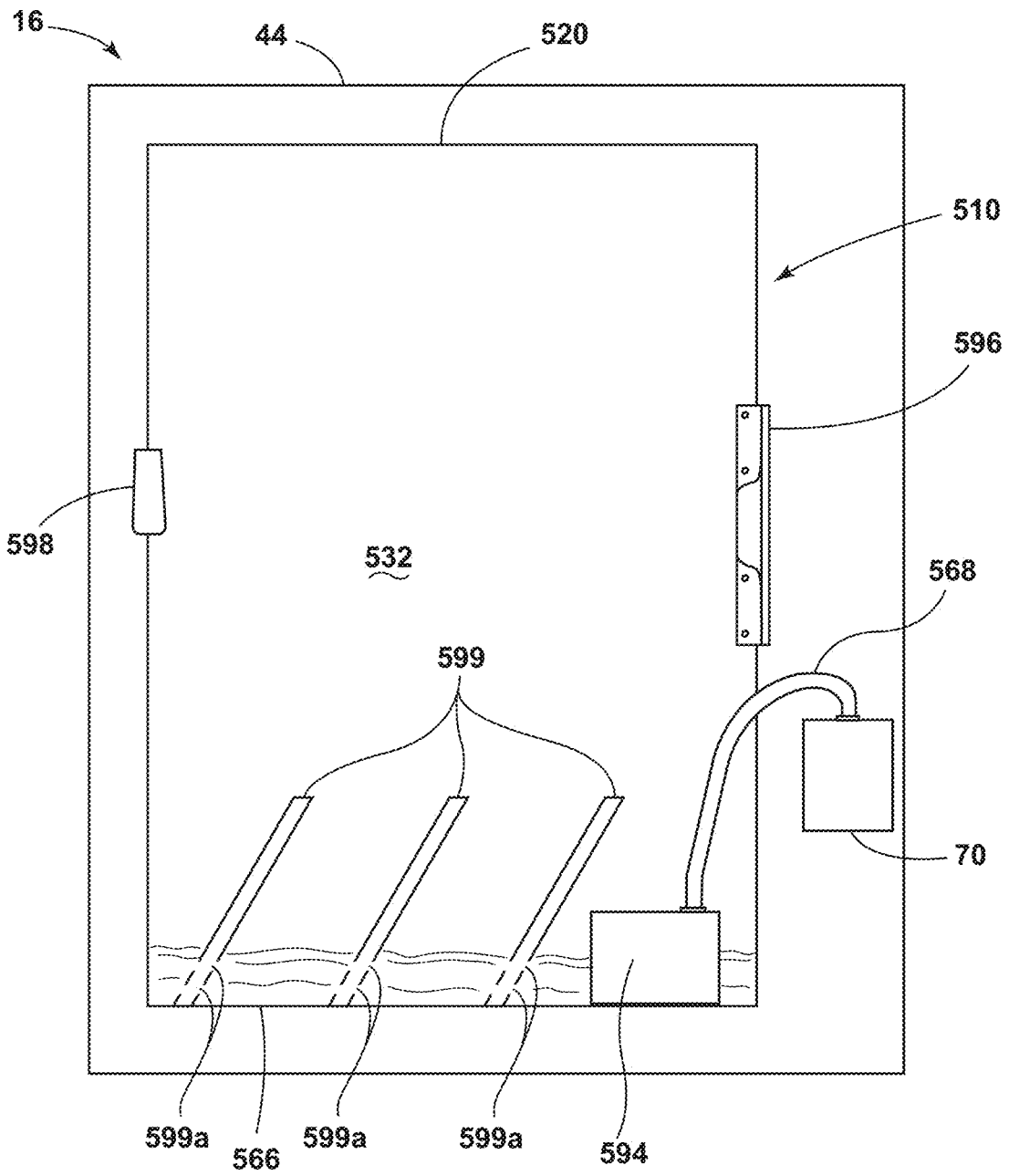
FIG. 5 is a front view of a schematic of a laundry treating appliance and a door assembly, according to an aspect of the present disclosure.

FIGS. 3, 4, and 5 illustrate portions of a door assembly 310, 410, and 510, respectively that include some components that are similar to the door assembly 10 of FIG. 1A and some components that are different. Therefore, elements of the door assembly 310, 410, and 510 that are similar to the door assembly 10 are labeled with the prefix 300, 400, and 500, respectively. In FIGS. 3, 4, and 5, portions of the door assembly, such as the outer door wall and the baffle, are not shown for the sake of clarity. It is within the scope of the present disclosure for any one or more of the elements of the embodiments of FIGS. 3, 4, and 5 to be used with the door assembly 10 of FIG. 1A and/or the door assembly 110 of FIG. 2.

Referring to FIG. 3, the door assembly 310 can include a bottom wall 366 having an angled portion **366*a* that is angled downward toward a drain portion 366*b* to facilitate collecting the condensed liquid toward a liquid outlet, which in the embodiment of FIG. 3 is illustrated as a pump 394. The pump 394 can be configured to pump liquid condensed within the internal volume 332 to the storage container 70 of the laundry treating appliance 16 through the drain conduit 368. As illustrated in FIG. 3, the drain conduit 368 can be routed through the appliance cabinet 44 in the area located generally around a hinge 396 of the door assembly 310. As described above with respect to the drain conduit 68 of the embodiment of FIG. 1A, optionally, the drain conduit 368 can be coupled with an external drain line or an appliance drain system of the appliance, rather than the storage container 70. The pump 394 can be located within the internal volume 332 (as illustrated), carried by the door assembly 310, or located within the appliance cabinet 44. In configurations in which the pump 394 is disposed within the appliance cabinet 44, the pump 394 can be fluidly coupled with the drain portion 366***b* of the bottom wall 366 via a suitable drain line to drain the condensed liquid collected within the internal volume 332.

In another aspect, rather than having the pump 394 located at the drain portion 366*b*, the drain portion 366*b* can include a valve that is configured to selectively drain the condensed liquid. In this configuration, the valve can be configured to fluidly couple with a suitable inlet carried by the cabinet 44 when the door assembly 310 is closed.

FIG. 4 illustrates another exemplary configuration for draining liquid from the door assembly. As illustrated in FIG. 4, the bottom wall 466 can include first and second angled portions 466*a* and 466*b* which are both angled downward toward a liquid outlet that includes a valve 494. The valve 494 can be fluidly coupled with a drain conduit 468 for draining liquid from the internal volume 432 into the storage container 70. As described above with respect to the drain conduit 68 of the embodiment of FIG. 1A, optionally, the drain conduit 468 can be coupled with an external drain line or an appliance drain system of the appliance, rather than the storage container 70. In one aspect, the drain conduit 468 can be carried by the appliance cabinet 44 and configured to couple with the valve 494 when the door assembly 410 is closed. In another aspect, the drain conduit 468 can be carried by the door assembly 410 and routed into the appliance cabinet 44, such as in the area adjacent the door hinge 496, for example.

According to another aspect of the present disclosure, the valve 494 can be coupled with a pump carried by either the door assembly 410 or the appliance cabinet 44 to facilitate draining liquid from the internal volume 432. In another aspect, the valve 494 can be replaced by a pump, such as the pump 394 of the embodiment of FIG. 3.

With respect to the embodiments of FIGS. 3 and 4, the pump 394 and/or valve 494 can be controlled by the controller 60 of the laundry treating appliance 16 to drain liquid from the internal volume 332, 432 following a predetermined event and/or after a predetermined period of time. Examples of a predetermined event that would trigger the controller 60 to actuate the pump 394 and/or valve 494 include an end of a cycle of operation, a start of a cycle of operation, or the closing of the door assembly 310, 410 after a cycle of operation has ended or prior to the start of a cycle of operation. In another example, the pump 394 and/or valve 494 may be manually activated by a user providing a corresponding input to the controller 60 through the user interface 62. In another example, the door assembly 310, 410 may include a liquid level sensor that is communicably coupled with the controller 60 or directly coupled with the pump 394 and/or valve 494 to actuate the pump 394 or valve 494, respectively, when the collected liquid reaches a predetermined liquid level within the internal volume 332, 432. In yet another aspect, the valve 494 can be configured to automatically open when the door assembly 410 is closed to thereby drain any liquid that may have collected within the internal volume 432.

Referring now to FIG. 5, the door assembly 510 can include a plurality of baffles 599 extending from the bottom wall 566 into the internal volume 532. The baffles 599 can be configured to reduce movement of the liquid collected within the internal volume 532 as the door assembly 510 is moved between the open and closed positions. As the door assembly 510 is moved between the open and closed positions, movement of the collected liquid may generate a "sloshing" sound or feel that may not be enjoyable to a user. The baffles 599 may limit or damp movement of the liquid as the door assembly 510 is moved, which may decrease the intensity of the sound and/or feel generated by the moving liquid. The shape, dimensions, location, and number of baffles 599 can be selected to provide the desired reduction in sound and/or feel of moving liquid as the door assembly 510 is moved. In some aspects, the baffles 599 can include one or more apertures 599*a* configured to allow liquid to flow between the areas separated by the baffles 599. The number, cross-sectional shape, spacing, and location of the apertures 599*a* can be selected based at least in part on a desired flow rate of liquid through the apertures 599*a* and/or a desired aesthetic, for example. Slowing the movement of liquid between the areas separated by the baffles 599 may facilitate damping the intensity of the sound and/or feel generated by the moving liquid. In some examples, the apertures 599*a* can be in the shape of a slot or a hole. The aperture(s) 599*a* in each baffle 599 can be the same or different. Optionally, the cross-sectional shape and/or spacing between apertures 599*a* in a given baffle 599 may vary. The baffles 599 can be used with a drain system that includes a pump 594, as illustrated, or any of the door assemblies, valves, and/or pump configurations described herein with respect to the embodiments of FIGS. 1-4.

As exemplified in the various FIGS. 1A-5, the designation of the bottom wall 66, 166, 366, 466, and 566 is intended to convey a bottom of the internal volume and does not necessarily indicated a bottom of the door assembly itself. Thus, in some embodiments, the bottom wall 66, 166, 366, 466, and 566 at least partially defines the internal volume of the door assembly and defines a bottom, exterior wall of the door assembly itself. In other embodiments, the bottom wall 66, 166, 366, 466, and 566 that at least partially defines the internal volume of the door assembly may be separate from a wall that defines an exterior, bottom portion of the door assembly itself.

Non-limiting aspects of the present disclosure are set forth below:

According to a first aspect of the present disclosure, a laundry treating appliance, includes: a cabinet defining an interior; a drum disposed within the cabinet and at least partially defining a treating chamber for treating laundry according to a cycle of operation; a blower configured to supply an airflow into the treating chamber to evaporate moisture from the laundry during a cycle of operation; and a door assembly coupled to the cabinet and configured to selectively open and close an access opening to the treating chamber, the door assembly including: an inner door wall including a portion that extends at least partially into the treating chamber when the door is closed, wherein the inner door wall includes an air inlet and an air outlet; an outer door wall adjacent to the inner door wall on a side of the inner door wall opposite the treating chamber, wherein the outer door wall and the inner door wall at least partially define an internal volume; and a baffle projecting from the inner door wall into the internal volume, wherein the baffle is disposed between the air inlet and the air outlet, and wherein at least a portion of the moisture evaporated by the airflow flows through the internal volume and condenses on the outer door wall.

According to a second aspect of the present disclosure, the laundry treating appliance of the first aspect, wherein one of the air inlet, the air outlet, or both include a plurality of apertures formed in the inner door wall.

According to a third aspect of the present disclosure, the laundry treating appliance of the first or second aspect, further including: at least one blower disposed adjacent one of the air inlet, air outlet, or both, wherein the at least one blower is configured to move at least a portion of the airflow through the internal volume.

According to a fourth aspect of the present disclosure, the laundry treating appliance of any one of the first to third aspects, wherein the outer door wall includes a material having a higher thermal conductivity than the material forming the inner door wall.

According to a fifth aspect of the present disclosure, the laundry treating appliance of any one of the first to fourth aspects, further including: a liquid outlet configured to drain liquid from the internal volume, wherein the liquid outlet is coupled with at least one of a pump and valve.

According to a sixth aspect of the present disclosure, the laundry treating appliance of the fifth aspect, further including: a bottom wall coupling the inner door wall and the outer door wall, wherein the bottom wall is angled toward the liquid outlet.

According to a seventh aspect of the present disclosure, the laundry treating appliance of any one of the first to sixth aspects, further including: an exterior door wall adjacent the outer door wall, opposite the inner door wall, wherein the exterior door wall and the outer door wall at least partially define an external volume, and wherein the external volume is in fluid communication with ambient air.

According to an eighth aspect of the present disclosure, the laundry treating appliance of the seventh aspect, wherein the exterior door wall includes an ambient air inlet and an ambient air outlet.

According to a ninth aspect of the present disclosure, the laundry treating appliance of any one of the first to eighth aspects, further including: a bottom wall coupling the inner door wall and the outer door wall, wherein the bottom wall includes a plurality of baffles projecting from the bottom wall into the internal volume.

According to a tenth aspect of the present disclosure, a door assembly for selectively opening and closing an access opening to a treating chamber of a laundry treating appliance, the door assembly including: an inner door wall including a portion that is configured to extend at least partially into the treating chamber when the door is closed, wherein the inner door wall includes an air inlet and an air outlet; an intermediate wall adjacent to the inner door wall, wherein the intermediate wall and the inner door wall at least partially define an internal volume; a baffle projecting from the inner door wall into the internal volume, wherein the baffle is disposed between the air inlet and the air outlet; and an exterior door wall adjacent to the intermediate door wall, opposite the inner door wall, wherein the exterior door wall and the intermediate door wall at least partially define an external volume in fluid communication with ambient air, and wherein the internal volume is in fluid communication with an airflow inside the treating chamber when the door assembly is closed.

According to an eleventh aspect of the present disclosure, the laundry treating appliance of the tenth aspect, further including: at least one blower disposed adjacent one of the air inlet, air outlet, or both, wherein the at least one blower is configured to move at least a portion of the airflow through the internal volume.

According to a twelfth aspect of the present disclosure, the laundry treating appliance of the tenth or eleventh aspect, further including: at least one of a pump and valve for draining liquid from the internal volume.

According to a thirteenth aspect of the present disclosure, the laundry treating appliance of any one of the tenth to twelfth aspects, wherein the exterior door wall includes an ambient air inlet and an ambient air outlet.

According to a fourteenth aspect of the present disclosure, the laundry treating appliance of any one of the tenth to thirteenth aspects, further including: a bottom wall coupling the inner door wall and the intermediate wall, wherein the bottom wall includes a plurality of baffles projecting from the bottom wall into the internal volume.

According to a fifteenth aspect of the present disclosure, the laundry treating appliance of any one of the tenth to fourteenth aspects, wherein the intermediate wall includes a material having a higher thermal conductivity than the material forming the inner door wall.

According to a sixteenth aspect of the present disclosure, a door assembly for selectively opening and closing an access opening to a treating chamber of a laundry treating appliance, the door assembly including: an inner door wall including a portion that is configured to extend at least partially into the treating chamber when the door is closed, wherein the inner door wall includes an air inlet and an air outlet; an outer door wall adjacent to the inner door wall, wherein the outer door wall and the inner door wall at least partially define an internal volume; a baffle projecting from the inner door wall into the internal volume, wherein the baffle is disposed between the air inlet and the air outlet; and at least one blower disposed adjacent one of the air inlet, the air outlet, or both and configured to move an airflow through the internal volume.

According to a seventeenth aspect of the present disclosure, the laundry treating appliance of the sixteenth aspect, further including: at least one of a pump and valve configured to drain liquid from the internal volume.

According to an eighteenth aspect of the present disclosure, the laundry treating appliance of the sixteenth or seventeenth aspect, further including: a bottom wall coupling the inner door wall and the outer door wall, wherein the bottom wall includes a plurality of baffles projecting from the bottom wall into the internal volume.

According to a nineteenth aspect of the present disclosure, the laundry treating appliance of any one of the sixteenth to eighteenth aspects, wherein one of the air inlet, the air outlet, or both include a plurality of apertures formed in the inner door wall.

According to a twentieth aspect of the present disclosure, the laundry treating appliance of any one of the sixteenth to nineteenth aspects, wherein the outer door wall includes a material having a higher thermal conductivity than the material forming the inner door wall.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry treating appliance, comprising:

a cabinet defining an interior;

a drum disposed within the cabinet and at least partially defining a treating chamber for treating laundry according to a cycle of operation;

an appliance blower disposed within the cabinet and configured to supply an airflow into the treating chamber to evaporate moisture from the laundry during a cycle of operation; and a door assembly coupled to the cabinet and configured to selectively open and close an access opening to the treating chamber, the door assembly comprising:

an inner door wall comprising a portion that extends at least partially into the treating chamber when the door assembly is closed, wherein the inner door wall includes an air inlet and an air outlet;

an outer door wall adjacent to the inner door wall on a side of the inner door wall opposite the treating chamber, wherein the outer door wall and the inner door wall at least partially define an internal volume;

at least one blower disposed within the internal volume of the door assembly and adjacent one of the air inlet, air outlet, or both, wherein the at least one blower is configured to move at least a portion of the airflow from the treating chamber of the drum through the internal volume and back into the treating chamber, wherein the internal volume is in communication with the treating chamber and is sealed from an environment exterior when the door assembly is in a closed position relative to the cabinet; and a baffle projecting from the inner door wall into the internal volume, wherein the baffle is disposed between the air inlet and the air outlet, and wherein at least a portion of the moisture evaporated by the airflow flows through the internal volume and condenses on the outer door wall.

2. The laundry treating appliance of claim 1, wherein one of the air inlet, the air outlet, or both comprise a plurality of apertures formed in the inner door wall.

3. The laundry treating appliance of claim 1, wherein the outer door wall comprises a material having a higher thermal conductivity than the material forming the inner door wall.

4. The laundry treating appliance of claim 1, further comprising:

a liquid outlet configured to drain liquid from the internal volume, wherein the liquid outlet is coupled with at least one of a pump and valve.

5. The laundry treating appliance of claim 4, further comprising:

a bottom wall coupling the inner door wall and the outer door wall, wherein the bottom wall is angled toward the liquid outlet.

6. The laundry treating appliance of claim 1, further comprising:

an exterior door wall adjacent the outer door wall, opposite the inner door wall, wherein the exterior door wall and the outer door wall at least partially define an external volume, and wherein the external volume is in fluid communication with ambient air.

7. The laundry treating appliance of claim 6, wherein the exterior door wall comprises an ambient air inlet and an ambient air outlet.

8. The laundry treating appliance of claim 1, further comprising:

a bottom wall coupling the inner door wall and the outer door wall, wherein the bottom wall includes a plurality of baffles projecting from the bottom wall into the internal volume.

9. A door assembly for selectively opening and closing an access opening to a treating chamber of a laundry treating appliance, the door assembly comprising:

an inner door wall comprising a portion that is configured to extend at least partially into the treating chamber when the door assembly is closed, wherein the inner door wall includes an air inlet and an air outlet;

an intermediate wall adjacent to the inner door wall, wherein the intermediate wall and the inner door wall at least partially define an internal volume;

a baffle projecting from the inner door wall into the internal volume, wherein the baffle is disposed between the air inlet and the air outlet;

a pump for draining liquid from the internal volume, wherein the pump is disposed within the internal volume; and an exterior door wall adjacent to the intermediate wall, opposite the inner door wall, wherein the exterior door wall and the intermediate wall at least partially define an external volume in fluid communication with ambient air, wherein the internal volume is in fluid communication with an airflow inside the treating chamber when the door assembly is closed; and at least one blower disposed adjacent one of the air inlet, air outlet, or both, wherein the at least one blower is configured to move at least a portion of the airflow through the internal volume, and wherein the at least one blower is configured to prevent addition of ambient air into the treating chamber via the inner door wall, the intermediate wall and the exterior door wall.

10. The door assembly of claim 9, wherein the exterior door wall comprises an ambient air inlet and an ambient air outlet.

11. The door assembly of claim 9, further comprising:

a bottom wall coupling the inner door wall and the intermediate wall, wherein the bottom wall includes a plurality of baffles projecting from the bottom wall into the internal volume.

12. The door assembly of claim 9, wherein the intermediate wall comprises a material having a higher thermal conductivity than the material forming the inner door wall.

13. A door assembly for selectively opening and closing an access opening to a treating chamber of a laundry treating appliance, the door assembly comprising:

an inner door wall comprising a portion that is configured to extend at least partially into the treating chamber when the door assembly is closed, wherein the inner door wall includes an air inlet and an air outlet;

an outer door wall adjacent to the inner door wall, wherein the outer door wall and the inner door wall at least partially define an internal volume;

a baffle projecting from the inner door wall into the internal volume, wherein the baffle is disposed between the air inlet and the air outlet; and at least one blower disposed within an interior volume and adjacent one of the air inlet, the air outlet, or both and configured to move an airflow from the treating chamber, through the internal volume and back into the treating chamber, wherein the at least one blower is configured to recirculate the airflow directly between the treating chamber and the interior volume and prevent entry of ambient air into the treating chamber via the inner and outer door walls.

14. The door assembly of claim 13, further comprising:

at least one of a pump and valve configured to drain liquid from the internal volume.

15. The door assembly of claim 13, further comprising:

a bottom wall coupling the inner door wall and the outer door wall, wherein the bottom wall includes a plurality of baffles projecting from the bottom wall into the internal volume.

16. The door assembly of claim 13, wherein one of the air inlet, the air outlet, or both comprise a plurality of apertures formed in the inner door wall.

17. The door assembly of claim 13, wherein the outer door wall comprises a material having a higher thermal conductivity than the material forming the inner door wall.

* * * * *